US005741167A

United States Patent [19]

Hagerty

[11] Patent Number: 5,741,167

[45] Date of Patent: Apr. 21, 1998

[54] REMOTELY CONTROLLABLE SIGNAL GENERATING PLATFORM

[75] Inventor: James D. Hagerty, Tiverton, R.I.

[73] Assignee: The United States of America as represented by the Secretary of the Navy, Washington, D.C.

[21] Appl. No.: 550,038

[22] Filed: Oct. 30, 1995

[51] Int. Cl.[6] ..... B63B 21/52

[52] U.S. Cl. ..... 441/13; 441/19

[58] Field of Search ..... 441/1, 6, 11, 13, 441/16, 18, 19, 20; 114/264, 265, 266, 267

[56] References Cited

U.S. PATENT DOCUMENTS

| | | | |
|---|---|---|---|
| 3,961,259 | 6/1976 | Elstow et al. | 441/19 |
| 5,339,288 | 8/1994 | Blier et al. | 441/11 |

FOREIGN PATENT DOCUMENTS

| | | | |
|---|---|---|---|
| 2431411 | 1/1975 | Germany | 441/19 |

*Primary Examiner*—Stephen Avila
*Attorney, Agent, or Firm*—Michael J. McGowan; James M. Kasischke; Prithvi C. Lall

[57] ABSTRACT

A remotely controllable signal device, such as a buoy which may be used as a target for gunfire training includes platform, a radio receiver, a decoding device, and one or more visual location signaling devices. The platform is floatable in the case of a buoy. The visual location signaling devices provide a visual indication of the location of the device. The visual location signaling devices include smoke generating devices such as marine smoke canisters, and a light such as a strobe light. The light can be mounted on a short tower for higher visibility. The decoding device can be a dual-tone multiple frequency decoder, and can include a switching device which selectively activates one of a number of visual location signaling devices located on the platform. The radio receiver may be a UHF AM receiver. The platform can also include a Global Positioning System transceiver device to assist in tracking the platform in the open ocean. As another option, the platform can include a sonar pinger to allow acoustic tracking of the impacts of shells when implemented as a buoy on instrumented hydrophone tracking ranges.

18 Claims, 2 Drawing Sheets

REMOTELY CONTROLLABLE SIGNAL GENERATING PLATFORM

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

This invention relates to a remotely controlled visible signal generating platform and more particularly, to a radio controlled smoke and light generating buoy which allows remote radio controlled initiation of multiple smoke emitting and other signaling devices for use in counter-battery gunfire or other weapons training.

(2) Brief Description of the Prior Art

Due in part to recent changes in environmental regulations, the military may no longer fire target practice at actual land masses, such as islands. A requirement has thus arisen for a realistic and non-destructive way to simulate counter-battery fire from enemy targets.

One way of accomplishing this requirement is with a launchable training platform such as a buoy that may be placed in the ocean or other environments in the training area for use as a practice target for ships and other weapons launching platforms. These training platforms typically include a source of visual indication or signaling such as smoke or light, or both. To afford an element of surprise, the training platforms should become visible only after the practice session has commenced. Since the simulation area is often very large (many square miles) the visual signaling method must be discernible over a large distance of ocean.

To ensure the greatest element of surprise for target practice, the initiation time of a platform's visual signaling needs to be changeable at the last moment, even after the platform has been launched. If the initiation time may be changed anytime during the simulation, or not even activated or initiated at all, a more realistic gun training simulation would be possible.

The training platforms must be capable of being launched b helicopter into the simulation area. Helicopter launching would be convenient because helicopters will already be present in a weapons range to ensure range safety, and may quickly and randomly launch target training platforms without detection by the practice warships. Additionally, since the targets get sh at, the platforms will often get destroyed. Accordingly, platforms should be inexpensive to produce, preferably with or the-shelf devices.

SUMMARY OF THE INVENTION

Accordingly, it is an object of this invention to provide an inexpensive target simulation platform for use in counter-battery fire simulation.

It is a further object of this invention to provide a platform that is launchable from a helicopter.

It is a further object of the invention to provide a target simulation platform which can visually signal its location over many miles at sea during light or dark hours.

It is yet a further object of the invention to provide a target simulation platform which can be remotely controlled at any time before or during gunfire simulation practice.

This invention features a remotely controllable buoy having floating platform, a radio receiver, a signal decoding device responsive to signals received by the radio receiver, a power supply, and one or more visual location signaling devices. The visual location signaling devices provide a visual indication of the location of the remotely controllable buoy.

The visual location signaling devices include smoke generating devices such as marine smoke canisters, and a light such as a strobe light. The light can be mounted on a small tower on the buoy for higher visibility.

The signal decoding device may be a dual-tone multiple frequency (DTMF) decoder, and may include a switching device which selects and activates one of the visual location signaling devices. The radio may be a UHF AM receiver.

This remotely controllable buoy is deployable by a helicopter or ship. The buoy may also include a Global Positioning System modem device to assist in tracking the buoy in the open ocean by those controlling and scoring the target practice exercise.

DETAILED DESCRIPTION OF THE INVENTION

Figure 1:
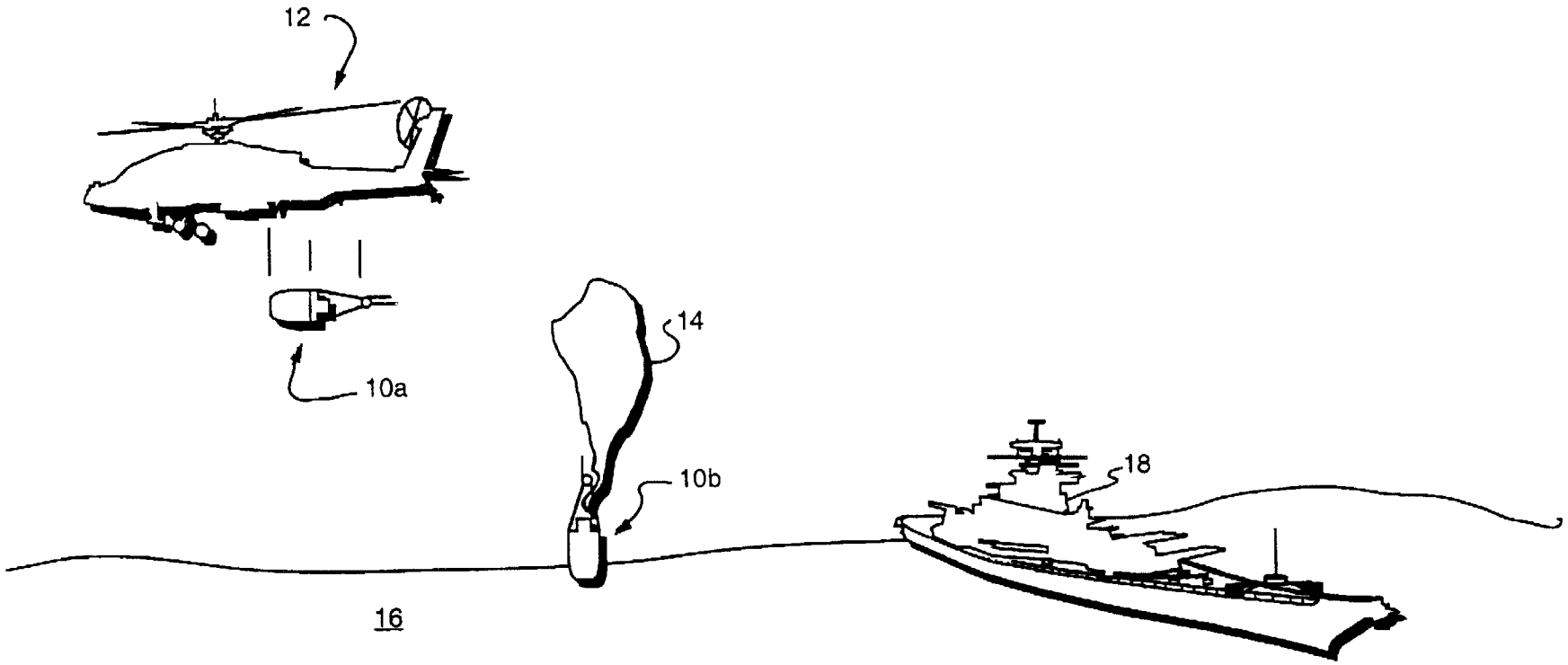
FIG. 1 illustrates deployment and use of a remotely controllable buoy according to the present invention.

The present invention features a remotely controllable signaling platform such as buoy 10*a*, FIG. 1 which is deployable by a number of means including a helicopter 12 into the ocean 16 or other area which forms part of a target range. Remotely controllable buoy 10*a* is also deployable by any other ocean craft, including small boats and mine layers. During a naval warfare practice scenario, several buoys 10 will be secretly distributed in the counter-battery firing simulation area. Helicopters 12 are a good means of distributing buoys 10 since helicopters will generally be in the counter-battery firing simulation area for monitoring the participants and to ensure simulation area safety.

Once the buoys 10 are launched, the naval warfare practice scenario commences with warships 18 patrolling the simulation area. When a simulation supervisor wishes to signal enemy gunfire, a radio signal will be sent to a buoy 10*b*, which activates one or several visual signal location devices, such as a smoke generating device, producing a smoke cloud 14, and signaling the position of buoy 10*b*. Warship 18 can then take appropriate defensive action, which may include gunfire to attempt to eliminate the target.

Since all buoys 10 are under radio control, they can be activated at any time during the naval warfare practice scenario, further allowing the simulation supervisor to alter the scenario at any time, by changing the firing sequence plan. After the naval warfare practice scenario is completed, the buoys 10 can be retrieved by helicopters or boats.

Figure 2:
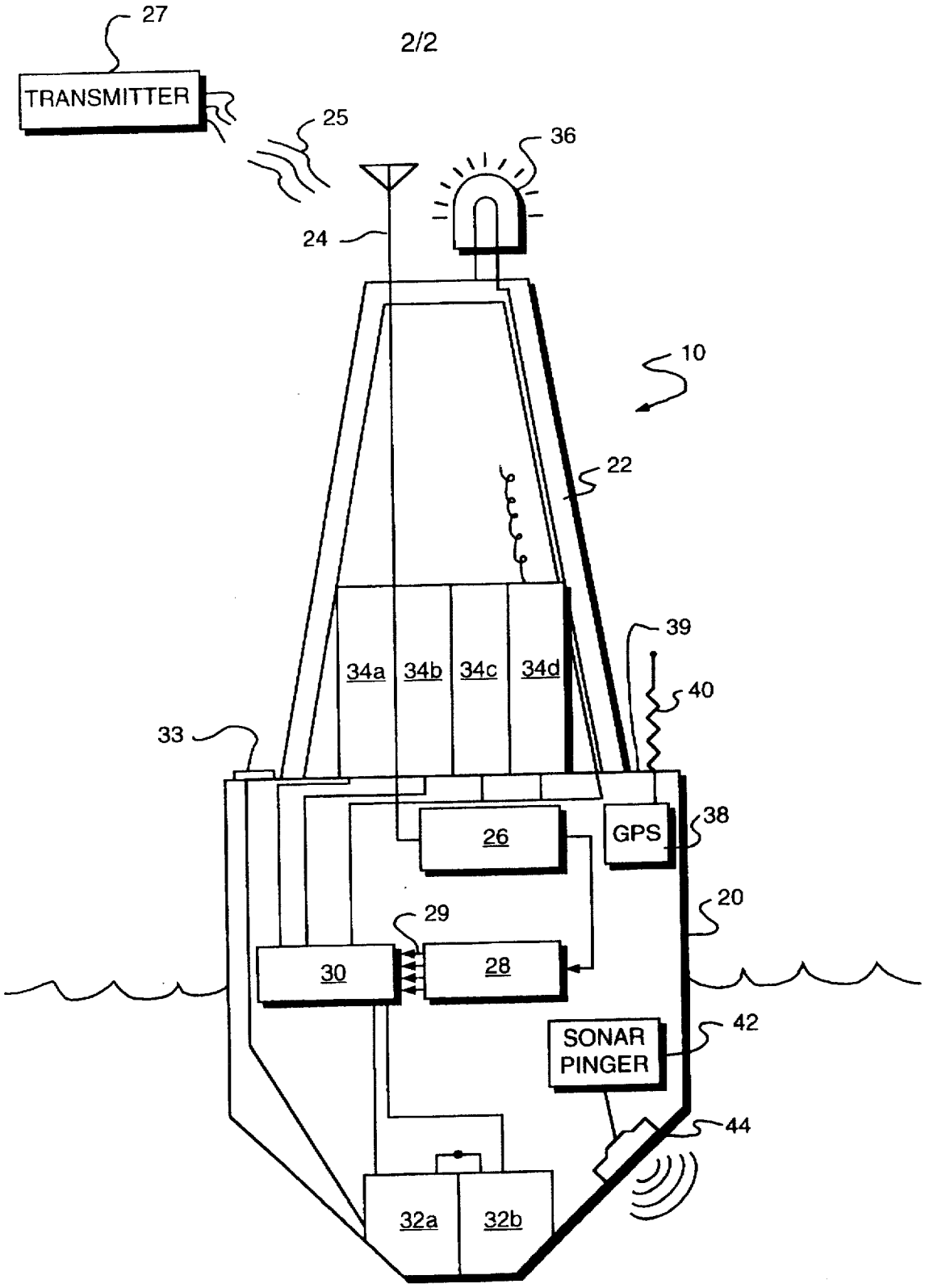
FIG. 2 is a remotely controllable buoy according to the present invention.

The remotely controllable buoy 10, of the present invention, shown in FIG. 2 is designed to be constructed from off-the-shelf parts, thereby keeping costs as low as possible for a device which can be reusable but can also suffer severe damage during use. The buoy 10 includes a platform 20 which may either be a conventional hemispheric buoy or a spar buoy. In the preferred embodiment, the buoy platform 20 is a sonobuoy canister such as that manufactured by Spartan Corporation. The buoy platform 20 provides an off-the-shelf device to house electronics and which has previously been field proven in helicopter launched sonobuoy exercises. The remotely controllable buoy 10 is typically powered by batteries 32 and can utilize a variety of gel cell batteries. An optional solar cell charging system 33 can augment or supplement the batteries 32.

The remotely controllable buoy 10 receives signals from an antenna 24 mounted on tower section 22. Antenna 24 connects electrically to a radio receiver 26. In the preferred embodiment, radio receiver 26 is a UHF AM receiving unit such as the Spartan AM/SSQ-58B receiver. In the preferred embodiment, radio receiver 26 receives signals 25 from a transmitter 27 or transceiver such as a Collins ARC-159 military UHF transceiver located at the site of the target range supervisor. In the preferred embodiment, the transceiver transmits DTMF (dual-tone multiple frequency) signals. Radio receiver 26 provides DTMF-encoded audio signals to DTMF decoder 28.

In the preferred embodiment, a DTMF decoder such as available as Model CS1688 from Connect Systems may be employed. DTMF decoder 28 provides a number of individual energizing signals 29 to power switching unit 30. Power switching unit 30 provides and connects power from batteries 32 to the individual visual signal location devices 34, 36. In the preferred embodiment, power switching unit 30 may include a mechanical relay such as the Magnecraft W171DTP-25, or a FET (field effect transistor) such as the International Rectifier IRF-530, or a solid state relay such as a Teledyne CD 21-CDW.

Visual signal location devices 34, 36 are also used to provide long range visual contact in the open ocean. They may take the form of smoke generating devices 34*a*-34*d*, which produce highly visible smoke clouds, or a flashing strobe light 36 which provides high visibility both during daytime and at night.

In the preferred embodiment, the smoke generating devices 34 are MK25 Mod 4 marine location markers (smoke generator/canister) or other electrically activated smoke generators. These devices normally operate with a sea water battery, and are thrown in the water to mark the position of submarines and men overboard. The devices are manufactured at the Naval Surface Weapons Center, Crane, Ind. They have proven track record in fleet operations and are visible for at least several miles in bright daylight.

MK25 Mod 4 marine location markers were primarily chosen for this application because of the ease in removing the standard sea water battery, and the subsequent modification for remotely controlled electronic detonation. A potential of 1.5 volts at 100 to 200 milliamps will initiate the smoke charge after the sea water battery is removed. Once a smoke charge generating device 34 is ignited, it cannot be shut off. The two charge initiation leads should be held at a ground (common) potential until the smoke generating device 34 is ready to be used, to minimize the possibility of a static build up prematurely initiating smoke generating device 34.

Visual location signaling devices 34, 36 can be mounted on the deck 39 of platform 20, or on tower support 22. A tower mounting may be preferable to allow further visibility at sea, and to keep incidental flames from smoke generating devices 34 away from the deck 39 which will minimize the possibility of igniting platform structure 20. If smoke generating devices 34 are to be mounted on the deck 39, a fire proof deck surface covering should be provided (not shown).

Power switching system 30 is responsive to individually decoded DTMF coded signals 29 for igniting individual smoke generating devices 34*a*-34*d*. Although four smoke generating devices are shown in FIG. 2, any number of smoke generating devices which will conveniently fit on deck 39 of platform 20 can be utilized. The number of devices can be limited in the current embodiment by the number of decoded DTMF signals needed for individually activating smoke generating devices 34 and light 36. Since each visual location signaling device 34, 36 is responsive to a separate tone or signal, the visual location signaling devices 34, 36 can be individually activated, or several such devices can be activated simultaneously.

Light 36 allows use of the remotely controllable buoy under low light conditions. Light 36 should be mounted a minimum of 4 feet above the water surface on tower 22 to allow visibility in rough seas. In the preferred embodiment, light 36 is a strobe light, which has high visibility of up to 3–5 miles during daytime use. A strobe light also allows flashes of light very similar to nighttime gunfire.

Several tracking devices are provided on the buoy 10, for allowing observers and supervisors to the counter-battery firing simulation to track the location of remotely controllable buoys 10, or to facilitate retrieval of the buoys 10 once the training is completed. An on-board global positioning system (GPS) receiver with radio modem 38 may be used to provide telemetry position readings from the buoy 10 back to shore or a retrieval vessel. A standard GPS antenna 40 can also be provided. The remotely controllable buoy 10 can also be tracked acoustically using an on board sonar pinger 42. Pinger 42 has an acoustic projector 44 for transmitting the pinger signal into the water. This allows hydrophone tracking of the remotely controllable buoy 10 in instrumented underwater ranges. A training supervisor can measure the proximity of battleship shells to the target by acoustically tracking the shells and comparing the results to the underwater signals of the sonar pinger 42.

This invention has uses beyond the ocean weapons training scenario. The present remotely controlled buoy 10 can also be used to mark locations in the open ocean for a longer time than provided by a standard single smoke generating device. For example, if a helicopter spots an object which requires a surface ship to investigate, the helicopter can drop a remotely controllable buoy 10 at the location. A regular single smoke marker will likely be depleted and the smoke dispersed by the time a surface ship reaches the general location. If a helicopter cannot stay in the area because of fuel limitations, the remotely controllable buoy will provide longer term marking of the area. When a surface vessel gets into the general area, it may send out a radio signal, activating the visual location signaling devices on the remotely controllable buoy 10. The buoy will then release a localized smoke signal, or if at night provide a lighting beacon. Since a remotely controllable buoy 10 according to the present invention contains several individually ignitable smoke generating devices as well as a reusable light, there is built-in safety and redundancy for marking a location.

Another use of the remotely controllable buoy 10 is for land based military operations. The platform 20 can be easily adapted to be placed on a military range to allow ground units to perform target practice. The device or buoy 10 could be dropped with a parachute from a helicopter or deployed with a land vehicle into any type of terrain or ground cover. The remotely controllable buoy 10 would perform in the same manner by firing smoke generating devices or flashing lighting devices.

Accordingly, the present invention allows easy deployment and remote controllability to allow an element of surprise in the detonation of the device, single or multiple detonation of smoke generating devices and extremely high visibility both during the day and night. This is achieved with a variety of economical off-the-shelf devices, most of which are reusable (except for the smoke generating devices), and provide ease of use under all conditions.

Many modifications of the presently disclosed invention will become apparent to those of skill in the art without departing from the scope of the appended claims.

What is claimed is:

1. A remotely controllable signal device comprising:

a platform;

a radio receiver disposed on said platform, for receiving radio signals;

a decoding device disposed on said platform and coupled to said radio receiver and responsive to said encoded audio signals for decoding said signals and for providing at least one decoded signal;

a power supply disposed on said platform and joined to said radio receiver and decoding device for providing power; and at least one visual location signaling device disposed on said platform and responsive to a predetermined at least one decoded signal, for providing a visual indication of the location of said device.

2. The device of claim 1, wherein said at least one visual location signaling device includes a smoke generating device.

3. The device of claim 1, wherein said at least one visual location signaling device includes a light.

4. The device of claim 1, wherein said at least one visual location signaling device includes a plurality of visual location signaling devices.

5. The device of claim 4, wherein said decoding device includes a switching device, for selectively activating one of said plurality of visual location signaling devices.

6. The device of claim 5, wherein said decoding device includes a dual-tone, multiple frequency decoder.

7. The device of claim 1, wherein said radio receiver includes an Ultra High Frequency (UHF) AM receiver.

8. The device of claim 1, wherein said remote controllable buoy is deployable from a helicopter.

9. The device of claim 1, wherein said platform is a buoy which can be deployed by a ship.

10. The device of claim 1 wherein said power supply includes batteries.

11. The device of claim 3 further comprising a tower support disposed on said platform said light being mounted on said tower support.

12. The device of claim 1 further comprising a Global Positioning System transceiver disposed on said platform.

13. The device of claim 5, wherein said decoding device provides a plurality of decoded signals, each said decoded signal activating a preselected one of said plurality of visual location signaling devices.

14. The device of claim 9 further comprising a pinger positioned in said platform in communication with the surrounding water.

15. A remotely controllable buoy comprising:

a floatable platform;

a radio receiver disposed in said platform for receiving radio signals;

a dual-tone multiple frequency decoder, disposed in said platform and joined to said radio receiver, for decoding said received radio signals and providing a plurality of decoded signals;

a power source joined to said receiver and decoder; and a plurality of smoke generating devices, joined to said decoder each of said plurality of smoke generating devices individually selectively responsive to said power source and to a predetermined one of said plurality of decoded signals for producing smoke.

16. The remotely controllable buoy of claim 15, further comprising at least one light signaling device, coupled to said power source and to said dual-tone multiple frequency decoder, and responsive to a predetermined one of said plurality of decoded signals, for providing a visual signal.

17. The device of claim 16 further comprising a global positioning system transceiver disposed on said platform.

18. The device of claim 16 further comprising a pinger positioned in said platform in communication with the surrounding water.

* * * * *